US007413505B1

(12) United States Patent
Rowlen, Jr.

(10) Patent No.: US 7,413,505 B1
(45) Date of Patent: Aug. 19, 2008

(54) PIPE AND SHAFT SANDER

(76) Inventor: Michael A. Rowlen, Jr., 107 Dogwood Ave., Bennettsville, SC (US) 29512

( * ) Notice: Subject to any disclaimer, the term of this patent is extended or adjusted under 35 U.S.C. 154(b) by 88 days.

(21) Appl. No.: 11/705,549

(22) Filed: Feb. 12, 2007

(51) Int. Cl.
*B24B 23/00* (2006.01)

(52) U.S. Cl. ..... 451/355; 451/513; 451/523

(58) Field of Classification Search ..... 451/355, 451/513, 524, 523
See application file for complete search history.

(56) References Cited

U.S. PATENT DOCUMENTS

| | | | | |
|---|---|---|---|---|
| 2,566,809 | A * | 9/1951 | Risley et al. | 451/311 |
| 2,759,305 | A | 8/1956 | Helbig | |
| D228,616 | S | 10/1973 | Tomo | |
| 3,895,463 | A | 7/1975 | Brandli et al. | |
| 4,600,444 | A | 7/1986 | Miner | |
| 4,869,026 | A * | 9/1989 | Burrell | 451/296 |
| 5,031,365 | A * | 7/1991 | Arndt et al. | 451/355 |
| 5,038,525 | A | 8/1991 | Gardner | |
| 5,643,062 | A * | 7/1997 | Joseph et al. | 451/355 |
| 5,649,852 | A | 7/1997 | Zepp | |
| 5,864,746 | A * | 1/1999 | Chang | 451/296 |
| 6,419,569 | B1 * | 7/2002 | Frech et al. | 451/355 |
| 6,736,711 | B2 * | 5/2004 | Tiede | 451/355 |
| 6,813,797 | B1 | 11/2004 | Kadinger | |
| 2001/0014577 | A1 * | 8/2001 | Frech et al. | 451/355 |
| 2001/0036802 | A1 * | 11/2001 | Mueller | 451/355 |
| 2006/0264161 | A1 * | 11/2006 | Schnell et al. | 451/355 |

* cited by examiner

*Primary Examiner*—Eileen P. Morgan
(74) *Attorney, Agent, or Firm*—Kyle Fletcher

(57) ABSTRACT

The present invention relates to a hand-held motorized device that is designed for sanding cylindrical objects. The invention comprises a left side and right side within which are a plurality of rollers, a motor, an on/off button, power supply, and sanding belt. A plurality of diameter knobs located on the exterior side of the housing enable a range of adjustment for various diameters. The sides can be disassembled to enable sanding belt replacement. The device has appealing uses comprising sanding down copper ends for soldering during plumbing installation.

5 Claims, 4 Drawing Sheets

PIPE AND SHAFT SANDER

CROSS REFERENCE TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of belt sanders that are adapted for pipes, shafts, and cylindrical objects.

B. Prior Art

The Brandli et al. patent (U.S. Pat. No. 3,895,463) discloses an apparatus for buffing and polishing the entire outer surface of cylindrical tubing. However, this patent is not portable, and does not utilize a sanding belt that is draped over the exterior surface of a cylindrical object. This patent also uses pneumatic circuits and hydraulic motors to transmit power to the moving parts.

The Gardner patent (U.S. Pat. No. 5,038,525) discloses a pipe and polishing apparatus and method which comprises a cradle having an open section and a pair of pivotable doors covering the open sections and adapted to move between an open, pipe receiving position and a closed, pipe polishing position, the doors biased to remain in an open, pipe receiving position. This patent does not utilize a sanding belt that is draped over the exterior surface of a cylindrical object with a housing that contains an electrical motor, as opposed to a device that attaches to the chuck of a standard drill.

The Kadinger patent (U.S. Pat. No. 6,813,797) discloses an adjustable wire brush tool for cleaning either the inside or the outside end of a copper pipe. This device attaches to the chuck of a standard drill, and is not expandable to accommodate the various diameters of cylindrical objects.

The Zepp patent (U.S. Pat. No. 5,649,852) discloses a reciprocating and rotating sanding apparatus which has an expandable/adjustable sanding sleeve. However, this device requires connection to a drill press, and utilizes a rotary drum sanding device that does not drape over the exterior surface of a cylindrical object.

The Miner patent (U.S. Pat. No. 4,600,444) discloses a pipe exterior end cleaning device comprising a plurality of rotating brushes. However, this device is not portable nor does it drape a sanding belt over the exterior.

The Burrell patent (U.S. Pat. No. 4,869,026) discloses a belt sander which is powered by an electric motor and polishes metal or wood work pieces to a cylindrical or curved shape. However, this patent requires an exterior motor to provide the mechanical means to rotate the sanding belt.

The Helbig patent (U.S. Pat. No. 2,759,305) discloses a portable polishing and abrading machine that is not designed to drape a sanding belt over the exterior surface of a cylindrical object.

The Tomo et al. patent (U.S. Pat. No. Des. 229,616) illustrates a design for a portable polishing device that is not directed to sanding and does not drape a sanding belt over the exterior surface of a cylindrical object.

BRIEF SUMMARY OF THE INVENTION

The present invention relates to a hand-held motorized device that is designed for sanding cylindrical objects. The invention comprises a left side and right side within which are a plurality of rollers, a motor, an on/off button, power supply, and sanding belt. A plurality of diameter knobs located on the exterior side of the housing enable a range of adjustment for various diameters. The sides can be disassembled to enable sanding belt replacement.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
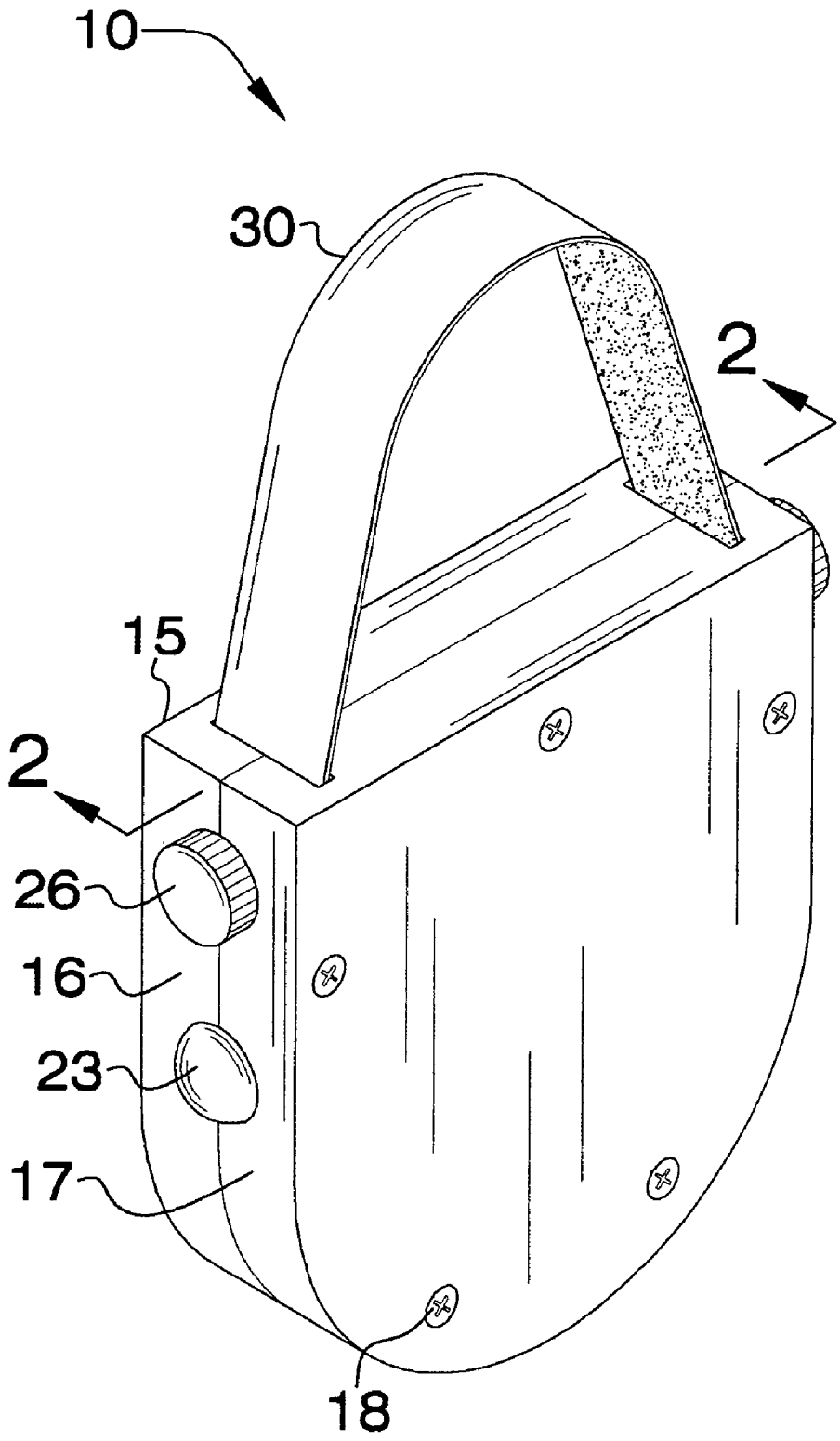
FIG. 1 illustrates an isometric view of the invention.
Figure 2:
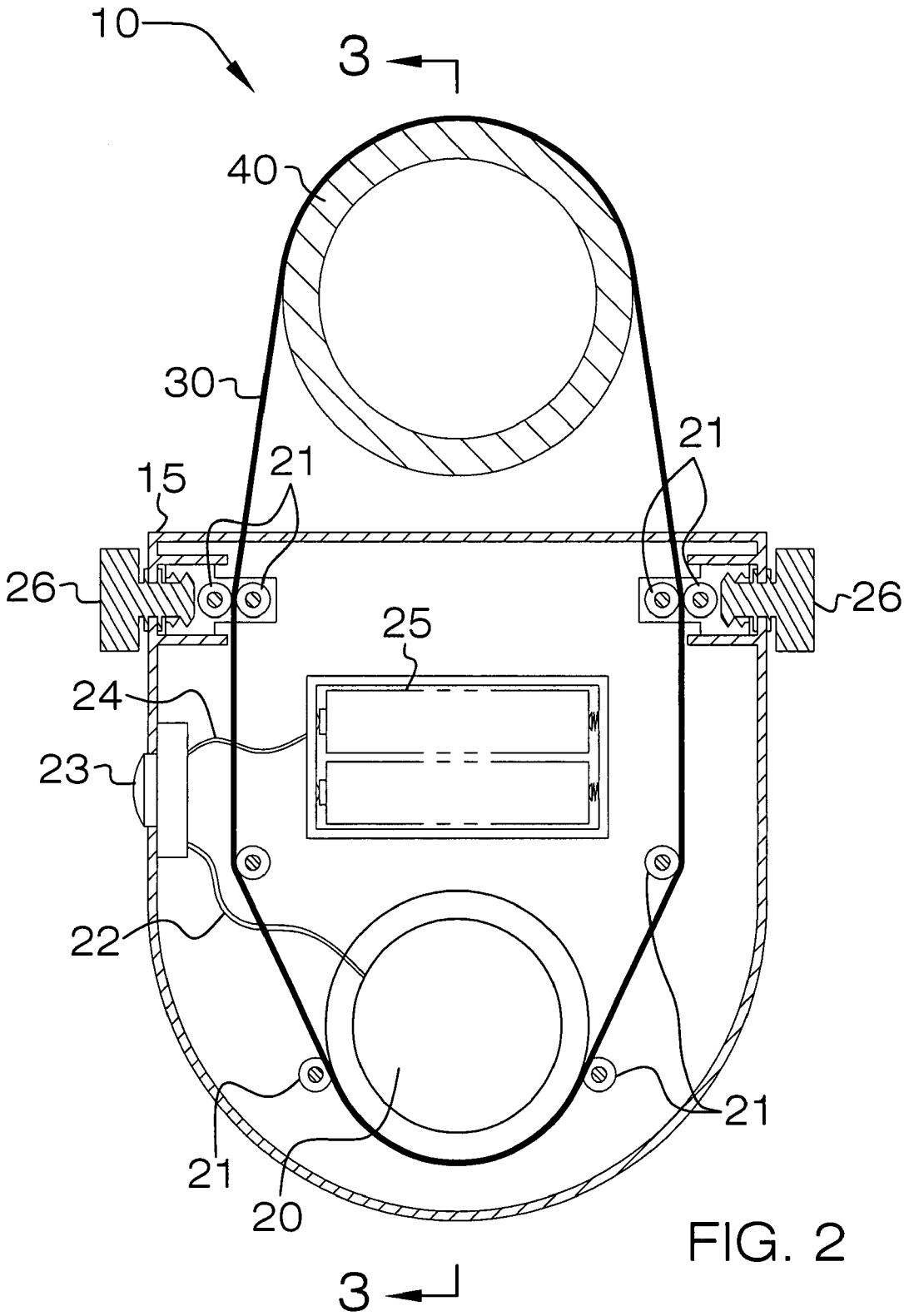
FIG. 2 illustrates a cross-sectional view of the invention along line 2-2.
Figure 3:
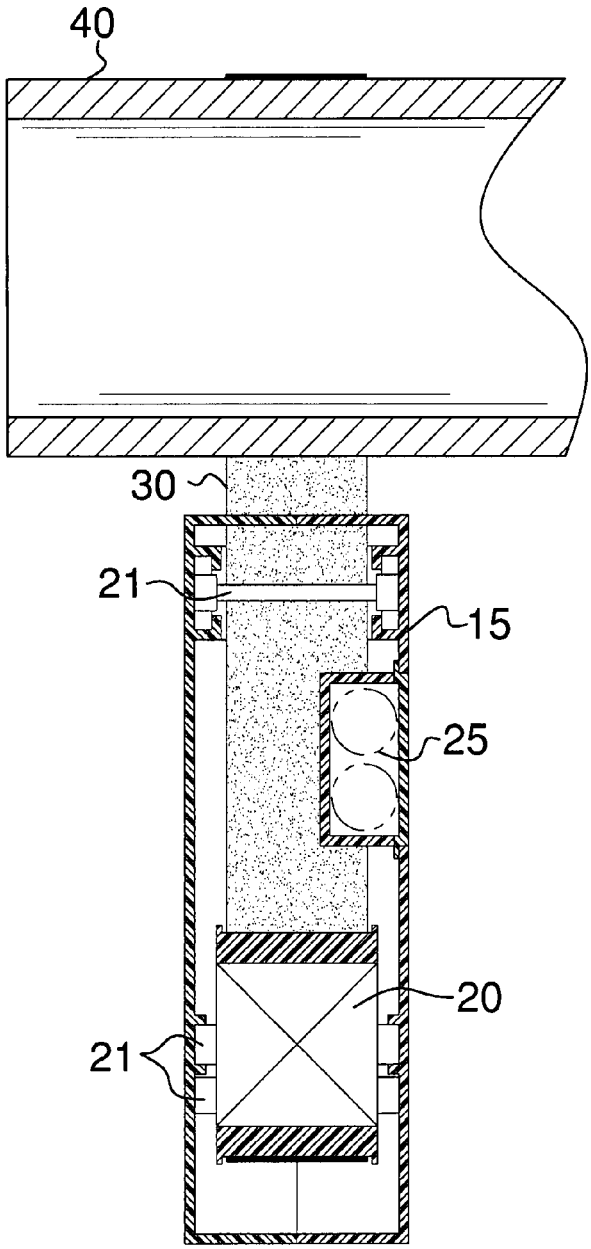
FIG. 3 illustrates a cross-sectional view of the invention along line 3-3.
Figure 4:
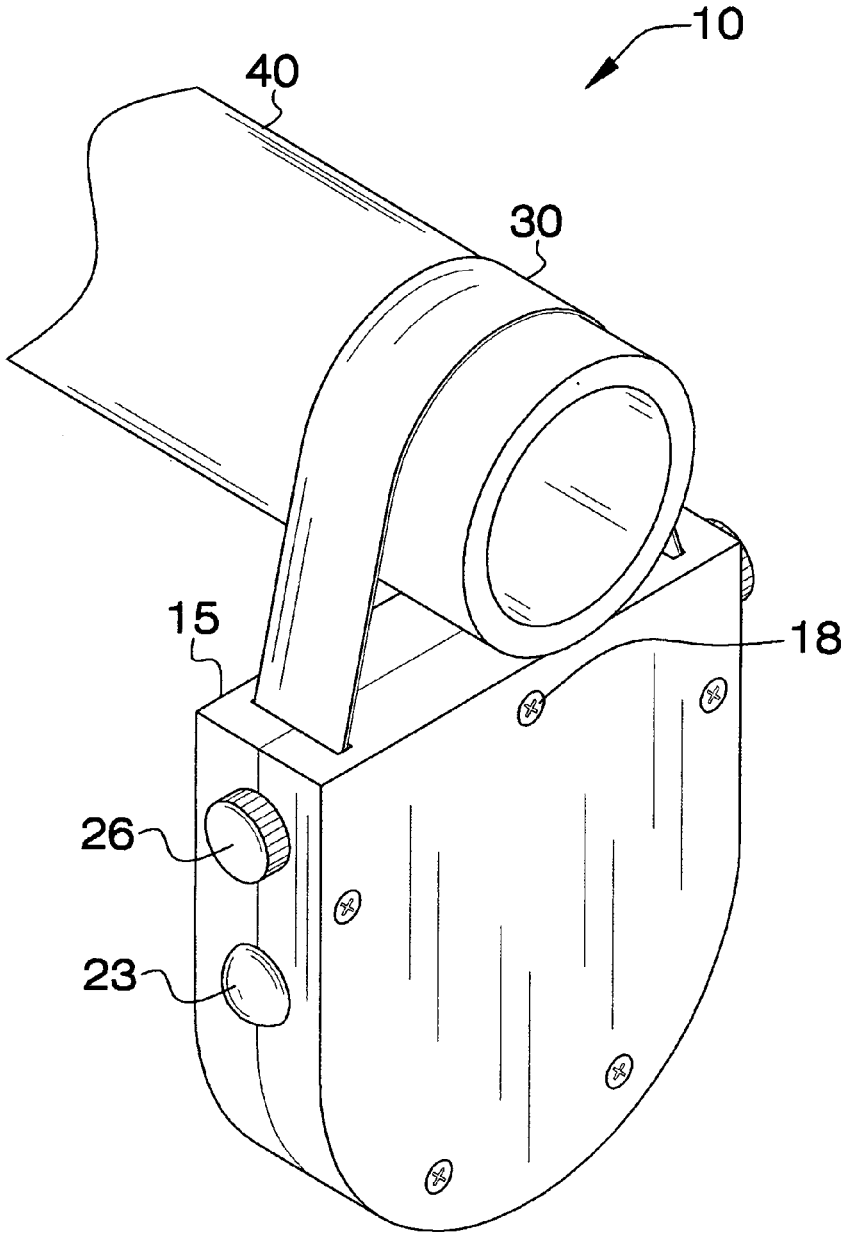
FIG. 4 illustrates an isometric view of the invention in use.

Detailed reference will now be made to the preferred embodiment of the present invention, examples of which are illustrated in FIGS. 1-4. The invention 10 comprises a housing 15, which is comprised of a left side 16 and a right side 17. The housing has the shape of a half oval. The left side 16 and right side 17 are connected by a plurality of fasteners 18, which comprise screws, rivets, and bolts. Container within the housing 15 is a motor 20, which is held in place by the left side 16 and right side 17. A plurality of guide rollers 21 are strategically located within the housing 15, and are held in place by the left side 16 and right side 17.

Connected to the motor 20 by a wire 22 is an on/off button 23, which in turn is connected by a wire 24 to a battery pack 25. It shall be noted that an alternative power source for the invention may be in the form of a transformer and power cord, which are not depicted in the Figures.

Located near the top interior of the housing 15 is a plurality of rollers 21 that are adjustable by a diameter adjustment knob 26. A sanding belt 30 is placed within the housing and travels around the rollers 21 and motor 20, and exits the housing 15. The sanding belt 30 has its sanding side located on the interior of the belt so that when placed around a pipe 40 it sands the exterior of the pipe 40. The diameter adjustment knob 26 has an end that protrudes through the housing 15, and enables the end user to adjust the diameter of the sanding belt 30.

The invention 10 is placed over an end of the pipe 40 and the on/off button 23 is depressed powering the invention 10. The end user then pulls on the invention 10, which forces the sanding belt 30 to engage the pipe 40. The end user continues operation until the material is sanded or polished to the desired level. Thereafter, the end user disengages the sanding belt from the pipe and turns the invention 10 off.

To replace the sanding belt 30, the fasteners 18 have to be removed and the left side 16 and right side 17 disconnected so as to expose the interior of the housing 15. Once the interior of the housing 15 is exposed, the sanding belt 30 can be removed and replaced. After the sanding belt 30 is replaced, the left side 16 and right side 17 are aligned and connected by attaching the fasteners 18.

The invention 10 can accommodate a wide range of sanding belts 30 that come in various grits. The housing can be scaled to a larger or smaller size so as to accommodate different ranges of pipes.

The invention claimed is:

1. An adjustable belt sanding device comprising:

(a) a housing;

(b) a plurality of guide rollers located in the interior of the housing;

wherein the guide rollers are held in place at each end by the housing;

wherein the guide rollers are free to rotate about their respective axis of rotation;

(c) a motor;

a motor driven roller for driving a sanding belt within the housing;

(d) the sanding belt;

wherein the sanding side of the belt is located on the interior side of the belt;

wherein part of the sanding belt traverses around all of the guide rollers and the motor drive roller located inside of the housing; and wherein the remaining part of the sanding belt is located outside of the housing, to define the working area;

(e) a plurality of belt diameter adjustment knobs wherein the knobs are located on the exterior of the housing;

wherein when the knobs are turned in a particular direction a pair of the guide rollers traverse to the left or right, depending on the particular direction, within the housing;

wherein as the pair of the guide rollers traverse inwardly (towards the middle of the housing), the overall diameter of the working area of the sanding belt is shortened;

wherein as the pair of the guide rollers traverse outwardly (away from the middle of the housing), the overall diameter of the working area of the sanding belt is increased.

2. The adjustable belt sanding device as described in claim 1 wherein the housing are made of a material comprising metal or plastic.

3. The adjustable belt sanding device as described in claim 1 wherein the motor is electrical, and is powered by an electrical cord.

4. The adjustable belt sanding device as described in claim 1 wherein the motor is electrical, and is powered by a plurality of batteries.

5. The adjustable belt sanding device as described in claim 1 wherein the the motor is electrical, and is powered by both an electrical cord or a plurality of batteries.

* * * * *